US011587479B2

(12) United States Patent
Zhang

(10) Patent No.: US 11,587,479 B2
(45) Date of Patent: Feb. 21, 2023

(54) DISPLAY PANEL AND DISPLAY DEVICE

(71) Applicant: Xiamen Tianma Micro-Electronics Co., Ltd., Xiamen (CN)

(72) Inventor: Peng Zhang, Shanghai (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 17/443,081

(22) Filed: Jul. 20, 2021

(65) Prior Publication Data

US 2022/0223077 A1 Jul. 14, 2022

(30) Foreign Application Priority Data

Dec. 28, 2020 (CN) ..... 202011587630.5

(51) Int. Cl.
*G09G 3/00* (2006.01)

(52) U.S. Cl.
CPC ..... *G09G 3/006* (2013.01); *G09G 2300/0426* (2013.01)

(58) Field of Classification Search
CPC ..... G09G 3/006; G09G 2300/0426
See application file for complete search history.

(56) References Cited

U.S. PATENT DOCUMENTS

2015/0310821 A1* 10/2015 Kim ..... G09G 3/3677 345/212
2015/0379927 A1* 12/2015 Cai ..... G09G 3/006 345/76
2017/0061909 A1* 3/2017 Chung ..... G09G 3/3677
2020/0042759 A1* 2/2020 Kim ..... G06F 3/0446
2020/0312209 A1* 10/2020 Yang ..... G09G 3/20
2020/0411623 A1 12/2020 Cui et al.

FOREIGN PATENT DOCUMENTS

CN 110297365 A 10/2019
CN 111048573 A 4/2020

* cited by examiner

*Primary Examiner* — Mark W Regn
(74) *Attorney, Agent, or Firm* — Alston & Bird LLP

(57) ABSTRACT

The present disclosure provides a display panel and a display device. The display panel includes a border region, an optical component region, and a main display region. The border region is provided with multiple load compensation units. At least one first data line is electrically connected to M load compensation units, so as to compensate for a load of the first data line, making the compensated load on the first data line and a load on the second data line are basically the same or tend to be the same. In this way, any display difference across different regions of the display panel due to a difference of the load on the first data line and the load on the second data line may be avoided, which in turn improves the display uniformity of the display panel and improves the display effect of the display panel.

19 Claims, 13 Drawing Sheets

DISPLAY PANEL AND DISPLAY DEVICE

CROSS REFERENCE OF RELATED APPLICATION

The present application claims priority to Chinese Patent Application No. 202011587630.5, filed on Dec. 28, 2020 with the China National Intellectual Property Administration, which is incorporated herein by reference in its entirety.

FIELD

The present disclosure relates to the field of display technology, and particularly to, a display panel and a display device.

BACKGROUND

With the continuous improvement of living standards, users have higher and higher requirements for a screen-to-body ratio of a display device. In order to meet this requirement, the display devices are gradually improved from narrow border to borderless to obtain better visual effects.

In conventional display devices, a position of an optical element set in the display device, such as a camera or a structured light emitting element, may have a certain negative impact on the display effect of the display device. Therefore, how to eliminate such negative impact is a problem to be solved urgently.

SUMMARY

In order to solve the above-mentioned technical problems, the present disclosure provides a display panel and a display device, so as to eliminate the adverse effects of the position of the optical element on the display effect of the display panel.

In an embodiment, the present disclosure provides a display panel. The display panel includes: a border region; an optical component region; a main display region at least partially surrounding the optical component region; a substrate; multiple display pixels and multiple data lines arranged on the substrate, the data lines including a first data line and a second data line, a number of display pixels electrically connected to the first data line being less than a number of display pixels electrically connected to the second data line, an extension direction of the first data line in the main display region intersecting the optical component region; and multiple load compensation units arranged in the border region, at least one first data line being electrically connected to M load compensation units, where M is an integer and is greater than or equal to 2.

In an embodiment, the present disclosure provides a display device including a display panel. The display panel includes: a border region; an optical component region; a main display region at least partially surrounding the optical component region; a substrate; multiple display pixels and multiple data lines arranged on the substrate, the data lines including a first data line and a second data line, a number of display pixels electrically connected to the first data line being less than a number of display pixels electrically connected to the second data line, an extension direction of the first data line in the main display region intersecting the optical component region; and multiple load compensation units arranged in the border region, at least one first data line being electrically connected to M load compensation units, where M is an integer and is greater than or equal to 2.

BRIEF DESCRIPTION OF THE DRAWINGS

For clearer illustration of the technical solutions according to embodiments of the present disclosure or conventional techniques, the drawings to be referred to in explaining embodiments of the present disclosure or conventional techniques are briefly described hereinafter. Apparently, the drawings described below are only embodiments of the present disclosure, and other drawings may be obtained by those skilled in the art based on the provided drawings without any creative effort.

DETAILED DESCRIPTION

Technical solutions in embodiments of the present disclosure are clearly and completely described below in conjunction with the drawings of the embodiments of the present disclosure. In view of the present disclosure, various alternations and changes to the present disclosure may be made without departing from the spirit or scope of the present disclosure. Therefore, the present disclosure is intended to cover modifications and changes of the embodiments, which fall within the scope of the appended claims (the claimed technical solutions) and their equivalents. It should be noted that the implementations provided in the embodiments of the present disclosure may be combined with each other as long as there is no conflict among them.

Figure 1:
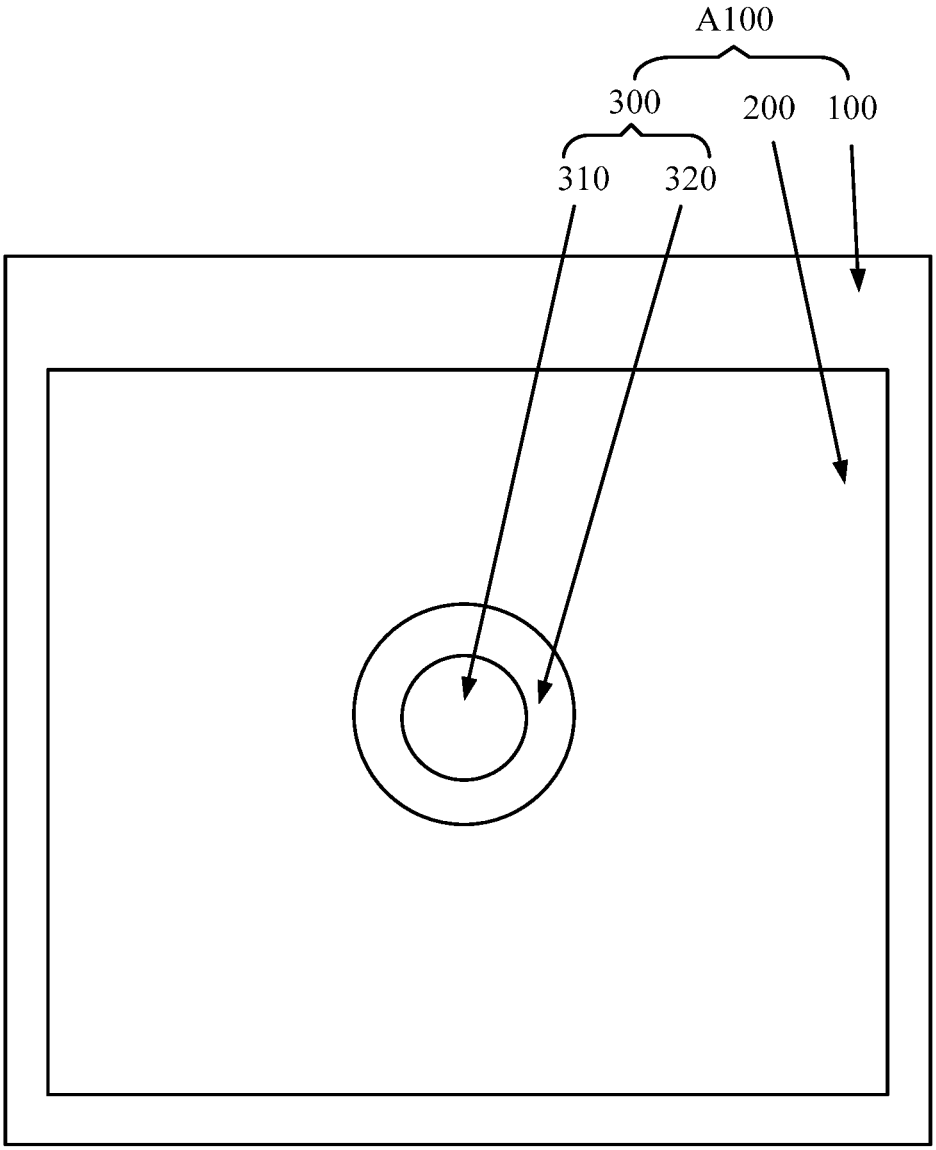
FIG. 1 is a schematic top view of a display panel according to an embodiment of the present disclosure.
Figure 2:
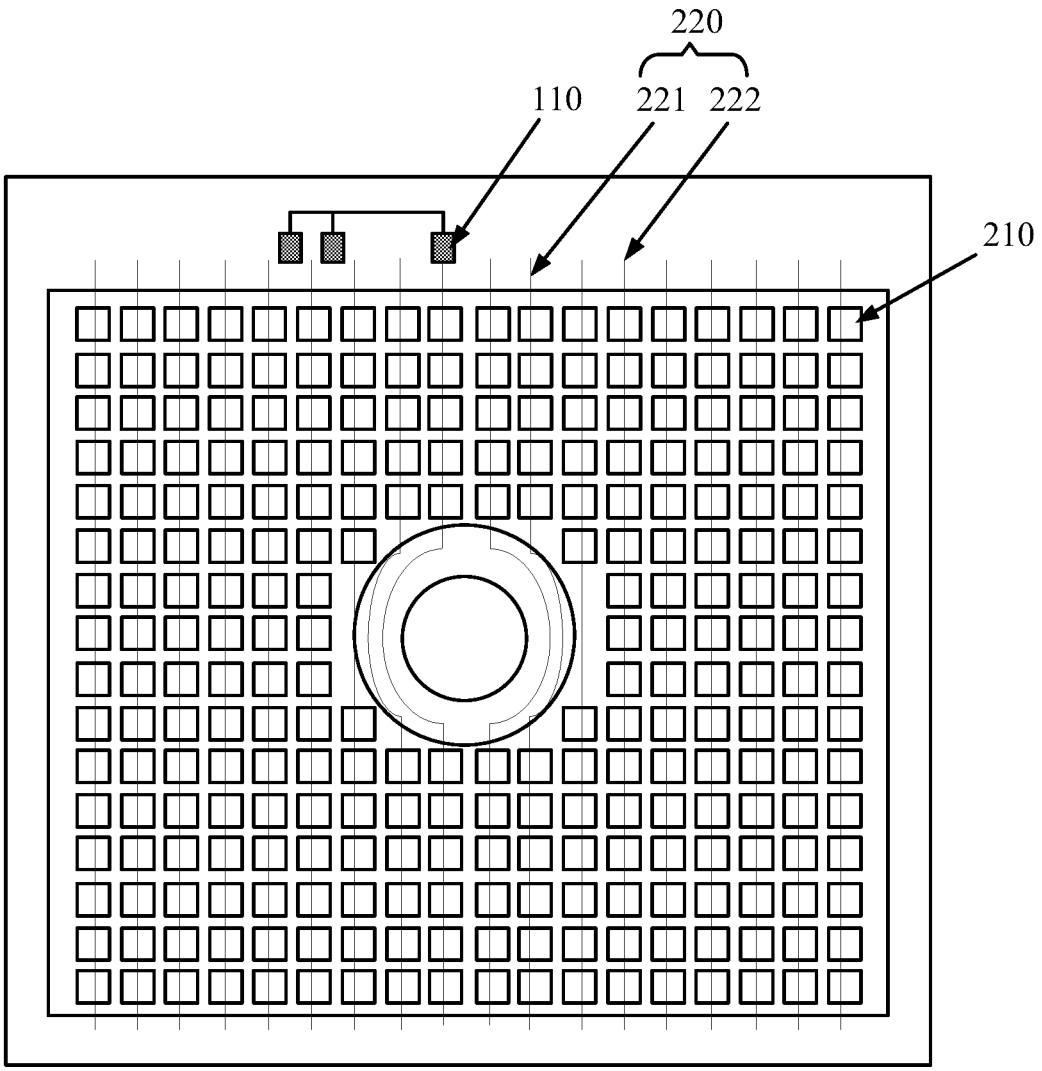
FIG. 2 is another schematic top view of a display panel according to an embodiment of the present disclosure.

FIG. 1 and FIG. 2 respectively shows a schematic top view of a display panel according to an embodiment of the present disclosure. As shown in FIGS. 1 and 2, the display panel includes a border region 100, an optical component region 300, and a main display region 200 which is arranged at least partially surrounding the optical component region 300. The display further includes a substrate, multiple display pixels 210 arranged on the substrate, and multiple data lines 220, each of the data lines may be defined as a first data line 221 or a second data line 222. The number of display pixels electrically connected to the first data line 221 is less than the number of display pixels electrically connected to the second data line 210. In addition, the first data line 221 extends in the main display region 200 in a direction that intersects the optical component region 300. Furthermore, the display further includes load compensation units 110 arranged in the border region 100. At least one first data line 221 is electrically connected to M load compensation units 110, where M is an integer equal to or greater than 2.

An Optical element may be arranged under the optical component region 300 (the side facing opposite to the light emitting direction for the display panel, or, the back side of the display panel). Therefore, the optical component region 300 usually has a greater light transmittance in comparison with the main display region 200. In order to meet such requirement for a light transmittance, there is usually no display pixel 210 or a small number of display pixels 210 arranged in the optical component region 300, which results in a smaller number of display pixels 210 connected to the first data line 221 than that of display pixels 210 connected to the second data line 222, and therefore causes the load on the first data line 221 being smaller than the load on the second data line 222. According to the embodiment in the present disclosure, by electrically connecting M load compensating unit 110 to the first data line 221, load on the first data line 221 may be compensated so that, after compensation, the load on the first data line 221 and the load on the second data line 222 become substantially the same, avoiding display differences throughout the display panel caused by the difference between the load on the first data line 221 and the load on the second data line 222. In this way, the display uniformity and thus the display effect of the display panel may be improved.

Furthermore, according to the embodiment in the present disclosure, the number of load compensation units 110 electrically connected to the first data line 221 is greater than or equal to two, so that the M load compensation units 110 electrically connected to the first data line 221 may be distributed in the border region 100 more flexibly. For example, the load compensation units 110 may be distributed in a small and unused region in the border region 100. In other words, the load compensation units 110 electrically connected to the first data line 221 are allowed to be distributed in the border region 100 as evenly as possible, so as to make full use of the space in the border region 100 of the display panel and balance adverse display effects such as parasitic capacitance and crosstalk caused by impacts of the load compensation units 110 on the display panel.

In one embodiment, there may be only one load compensation unit 110 electrically connected to the first data line 221, that is, any load that needs to be compensated on the first data line 221 is provided by one load compensation unit 110. The number of load compensation unit is not limited to the present disclosure, and may depend on the actual situation.

The number of the first data lines 221 connecting to the M load compensation units 110 may be one or two or more. In an implementation, if the unused space in the border region 100 is sufficient, the M load compensation units 110 may be electrically connected to each first data line 221.

The numbers of load compensation units 110 connected to each first data line 221 may be the same or different, which is determined by the difference between the load on the first data line 221 and the load on the second data line 222. Specifically, referring to the FIG. 1, there is no display pixel 210 or a small number of display pixels 210 arranged in the optical component region 300. Therefore, the larger the overlap between the first data line and the optical component region 300, the lower the load on the first data line 221; and the more load compensation units 110 electrically connected to the first data line 221, the greater the load for compensation. In this way, the load of the first data line 221 and the load of the second data line 222 are basically the same or tend to be the same.

FIG. 1 and FIG. 2 both illustrate embodiments in which the optical component region 300 includes a transition region 320 and a middle region 310. A part of the first data line 221 overlapping the optical component region 300 is arranged in the transition region 320.

A description of the M load compensation units 110 is provided in the following with reference to FIGS. 3, 4 and 5, each showing a schematic top view of a display panel according to another embodiment of the present disclosure.

Figure 3:
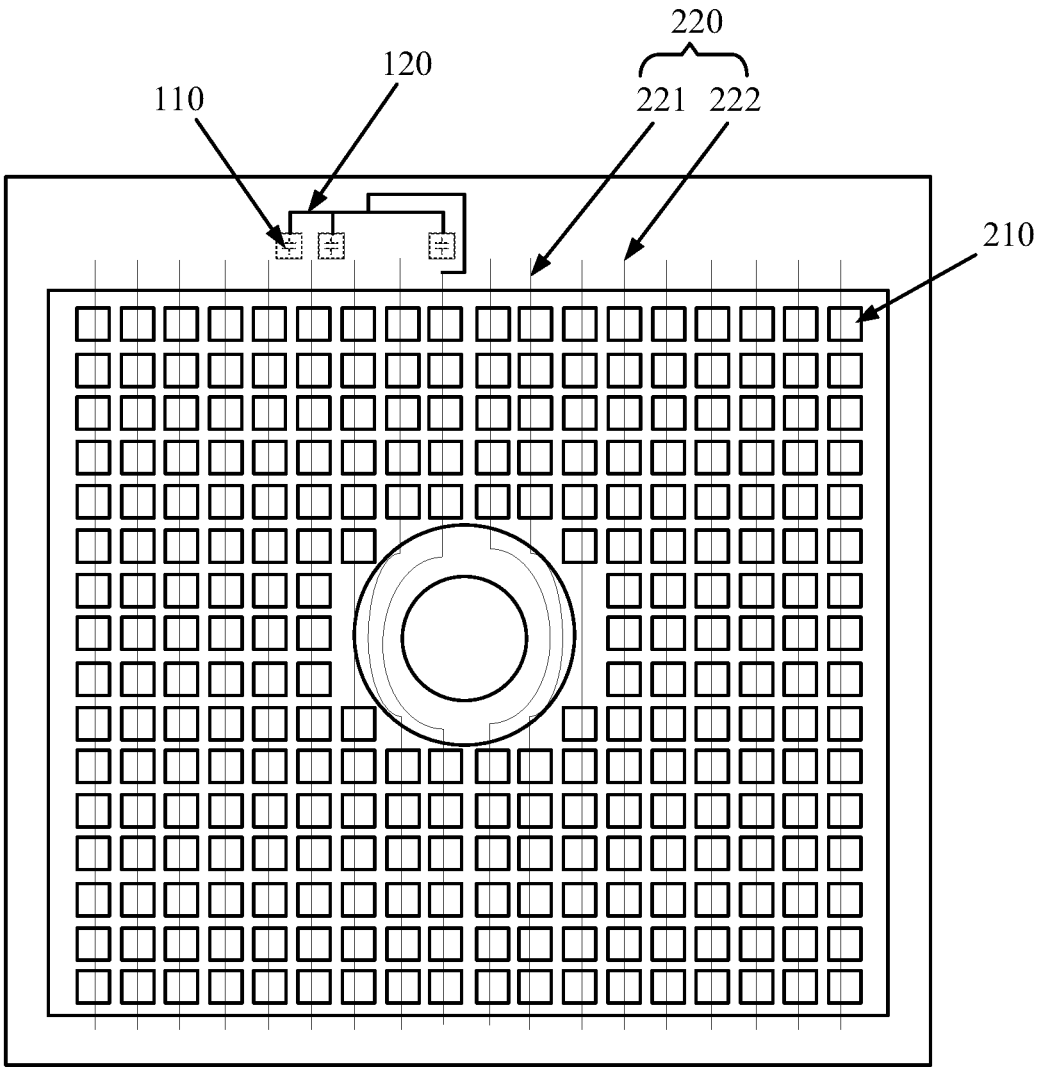
FIG. 3 is another schematic top view of a display panel according to an embodiment of the present disclosure.

As shown in FIG. 3, the display panel further includes a first connection line 120 in the border region 100.

The M load compensation units 110 are connected in parallel through the first connection line 120 to form a load compensation structure.

At least one first data line 221 is electrically connected to the load compensation structure.

According to the embodiment in the present disclosure, the load compensation unit 110 may be a capacitive load unit such as a capacitor. When the load compensation unit 110 is the capacitive load unit, the load compensation structure, formed by the M load compensation units 110 being connected in parallel through the first connection line 120, has a load defined by a sum of the loads of each of the M load compensation units 110, that is, $C_{total}$=C1+C2+ . . . CM. In an implementation, the first data line 221 may be electrically connected to the first connection line 120.

In addition, since the display pixel 210 has a capacitive load, the use of the capacitive load unit enables the load compensation structure to provide a load compensation type that is the same as the load type of the display pixel 210. In this way, it is relatively easier to determine a total load of the load compensation unit 110, without considering any influence on the phase of a data signal due to other types of loads.

Figure 4:
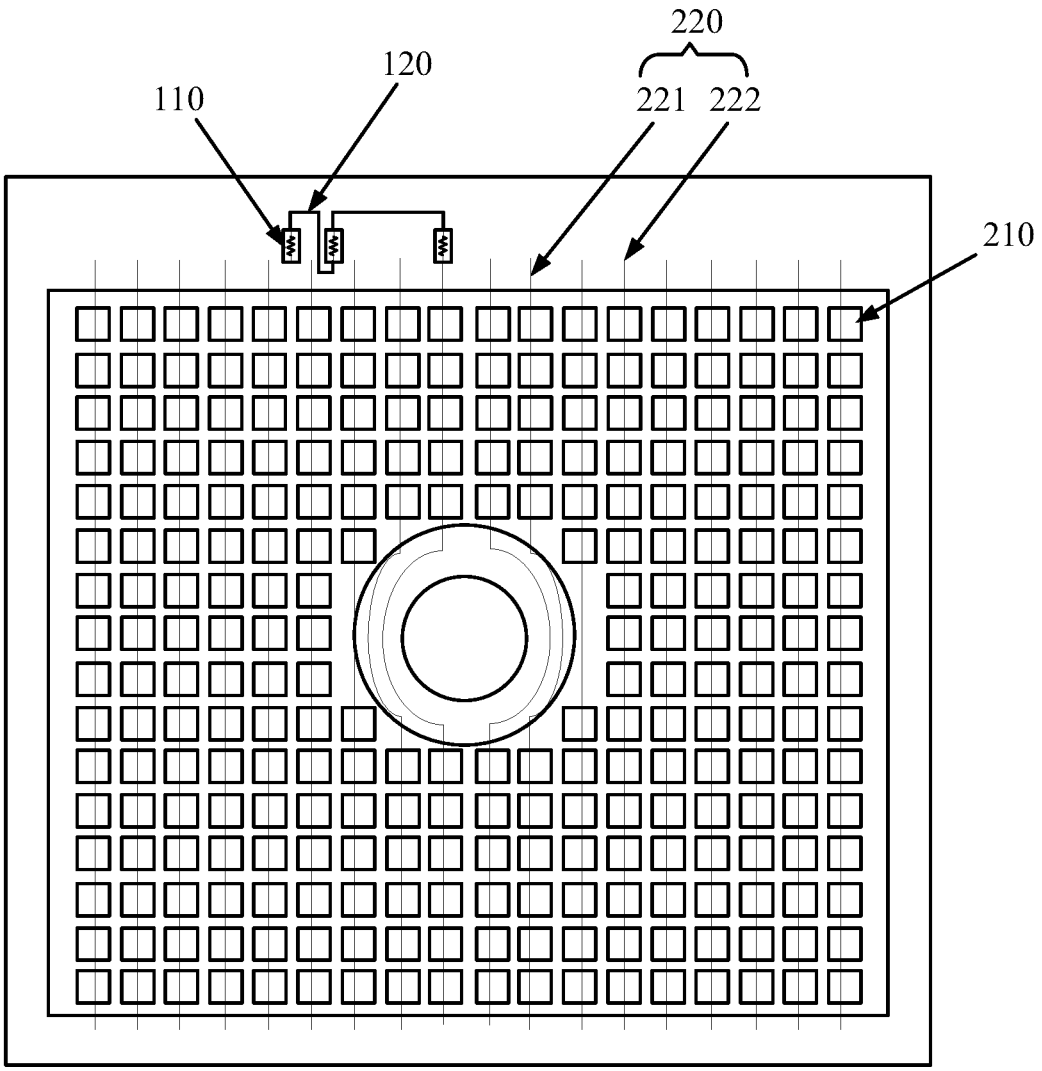
FIG. 4 is another schematic top view of a display panel according to an embodiment of the present disclosure.

Referring to FIG. 4, according to another embodiment in the present disclosure, the load compensation unit 110 may be a resistive load such as a resistor. Using a resistor as the load compensation unit 110 has an advantage of a simple structure being made based on a single layer of metal, which may facilitate to simplify the preparation process for the load compensation unit 110. When the load compensation unit 110 is the resistive load, based on a formula for calculating a load of the resistive load, the M load compensation units 110 are connected in series, so that a sum of loads of each of the M load compensation units 110 may be provided as a compensation for the first data line 221.

Figure 5:
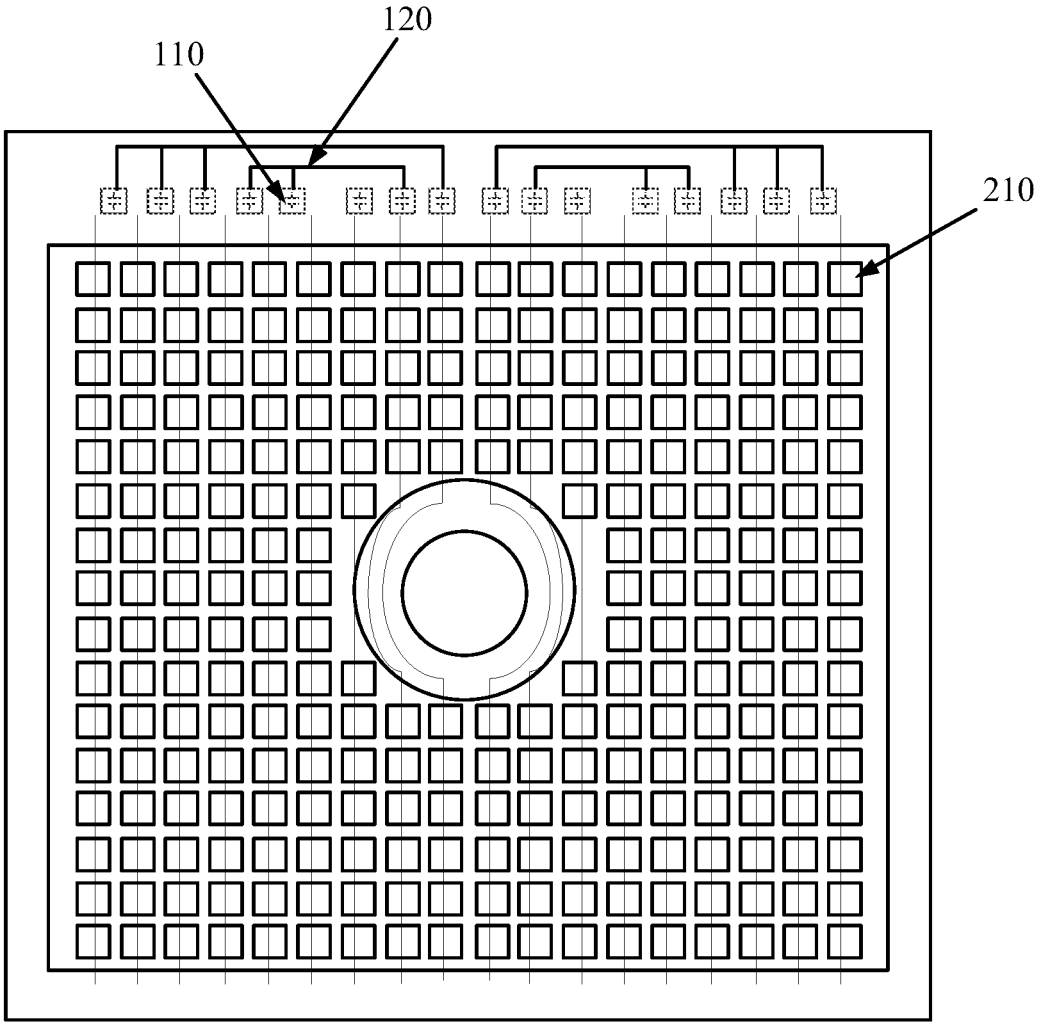
FIG. 5 is another schematic top view of a display panel according to an embodiment of the present disclosure.

According to the embodiment shown in FIG. 5, the display panel further includes a first connection line 120 arranged in the border region 100.

Among the M load compensation units 110 connected to the first data line 221, M−1 load compensation units 110 are connected in parallel through the first connection line 120 and are connected with the remaining one load compensation unit 110 in series.

According to the embodiment in the present disclosure, each of the load compensation units 110 may be a capacitive load. In this case, the M−1 load compensation units 110 connected in parallel are capable of withstanding a relatively high value of voltage. The M−1 load compensation units 110 are further connected to the remaining one load compensation unit 110 in series so as to provide sufficient load compensation. Accordingly, the M load compensation units 110 may provide a total load of $C_{total}=(C1\times C2\times \ldots CM-1)/(C1+C2+\ldots CM-1)+CM$. In an implementation, the first connection line 120 and the first data line 221 are respectively connected to different electrode plates of the remaining one load compensation unit 110.

In addition, the M load compensation units 110 may include both capacitive loads and resistive loads. In other words, the M−1 load compensation units 110 connected in parallel may be resistive loads, while the remaining one load compensation unit 110 may be a capacitive load. In this case, the M load compensation units 110 may provide a total load being the overall load of the resistive loads of the M−1 load compensation units 110 and the capacitive load of the remaining one load compensation unit 110. In this way, the M load compensation units 110 include both capacitive loads and resistive loads. A load compensation unit 110 that provides a capacitive load may compensate for the signal phase delay caused by the resistive loads.

Referring to FIG. 3 or FIG. 5, according to another embodiment in the present disclosure, the first connection line 120 is arranged on a side of the load compensation units 110 facing away from the main display region 200.

Accordingly, the first connection line 120 does not overlap with any data line 220 arranged in the border region 100, so that capacitive coupling between the first connection line 120 and the data line 220 may be avoided, that is, any crosstalk to a data signal in the data line 220 caused by a capacitive coupling due to overlapping metal lines is avoided.

In an implementation, referring to FIG. 5, according to another embodiment in the present disclosure, different first connection lines 120 are non-overlapping in a direction perpendicular to a plane where the substrate is located.

Accordingly, in the embodiment provided in the present disclosure, different first connection lines 120 do not overlap each other in the direction perpendicular to the plane where the substrate is located. Therefore, capacitive coupling caused by overlapping of the first connection lines 120 may be avoided, which in turn avoids any crosstalk to a data signal in the data line 220 caused by the capacitive coupling.

Figure 6:
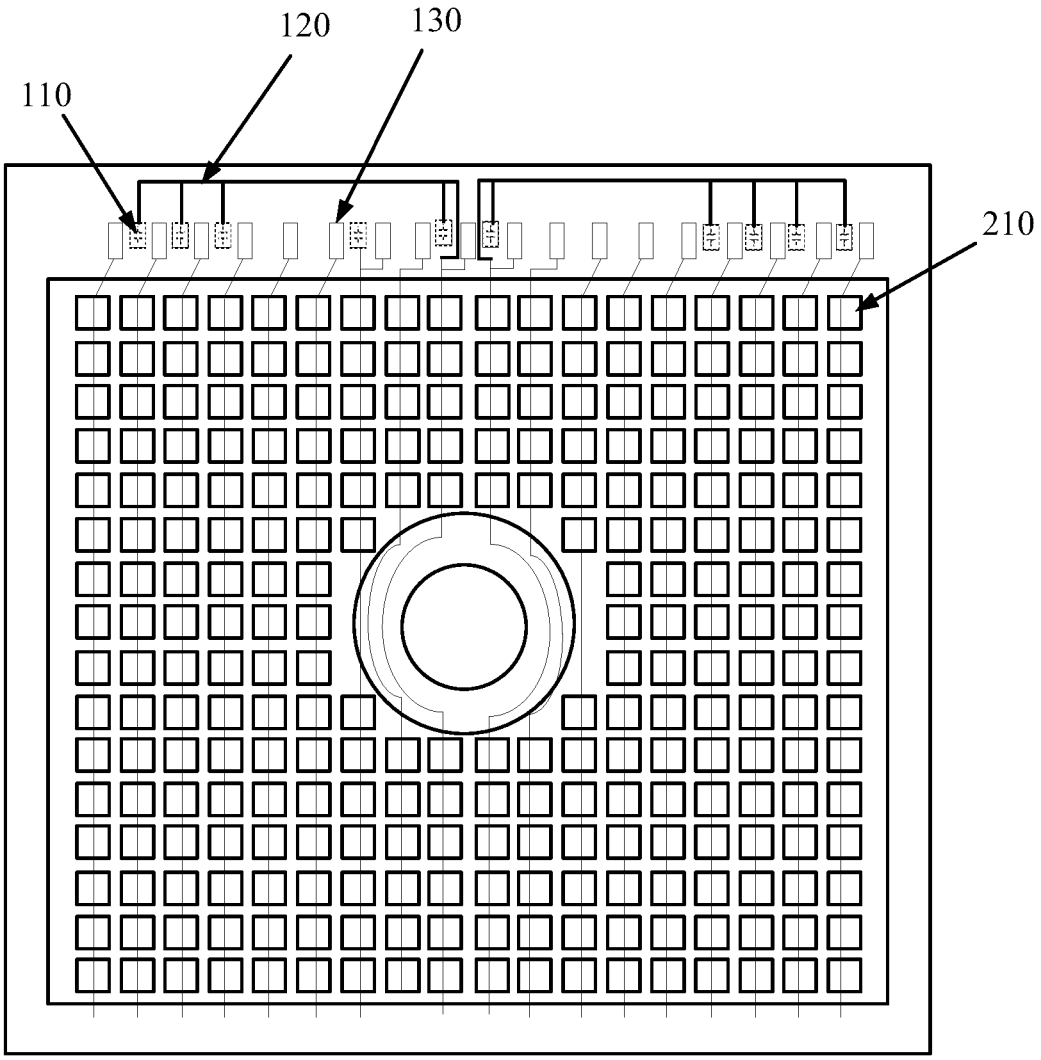
FIG. 6 is another schematic top view of a display panel according to an embodiment of the present disclosure.

Based on the above embodiments, FIG. 6 shows a schematic top view of a structure of a display panel according to another embodiment of the present disclosure. In the display panel, the border region 100 further includes multiple electrostatic discharge units 130 electrically connected to the data line 220. At least one load compensation units 110 is arranged between two adjacent electrostatic discharge units 130.

In general, each of the data lines 220 is electrically connected to one of the electrostatic discharge units 130, to release any remaining electric charge on the data line 220 so as to prevent abnormal display caused by accumulated electric charges.

In the embodiment provided in this disclosure, space between the two adjacent electrostatic discharge units 130 is substantially used, that is, the at least one load compensation unit 110 is arranged between the two adjacent electrostatic discharge units 130. Therefore, there is no need to additionally expand space of the border region 100 for the load compensation unit 110, leading to an increased the screen-to-body ratio for the display panel.

According to the load provided from a single load compensation unit 110, the space between adjacent electrostatic discharge units 130, and the number of load compensation units 110 to be placed between the adjacent electrostatic discharge units 130, it may be determined to dispose one, two or more load compensation units 110 between adjacent electrostatic discharge units 130, which is not limited to the present disclosure and may depends on an actual situation.

As shown in FIG. 6, the first data line 221 is connected in parallel with the electrostatic discharge unit 130 and M load compensation units 110. In other embodiments of the present disclosure, the first data line 221 may be connected to the electrostatic discharge unit 130 first and then connected to the M load compensation units 110, or may be connected to the M load compensation units 110 first and then connected to the electrostatic discharge unit 130, which is not limited herein.

The following description illustrates a structure of a load compensation unit that provides a capacitive load.

Figure 7:
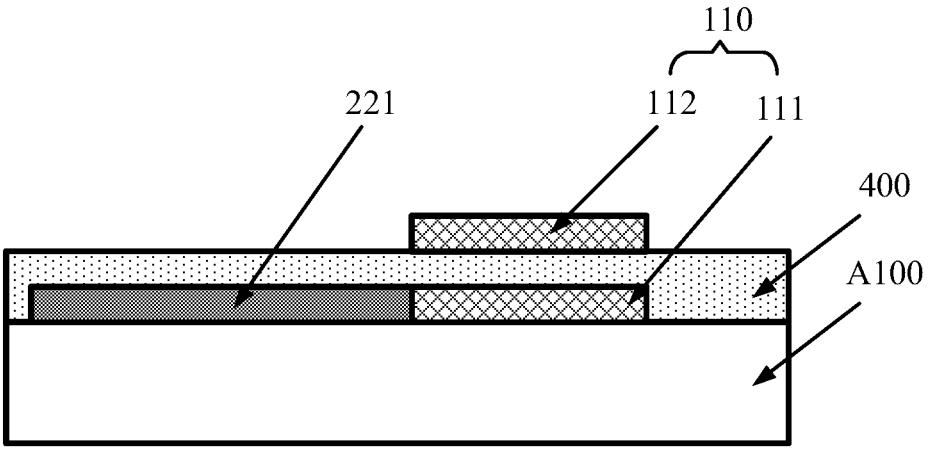
FIG. 7 is a schematic sectional view of a display panel according to an embodiment of the present disclosure.

FIG. 7 is a schematic sectional structure diagram of a load compensation unit in an example where the load compensation unit provides a capacitive load (a capacitor). The load compensation unit 110 includes a first electrode plate 111 and a second electrode plate 112 arranged opposite to each other.

Specifically, the second electrode plate 112 is arranged on the side of the first electrode plate 111 facing away from the substrate A100. A first insulating layer 400 is provided between the first electrode plate 111 and the second electrode plate 112.

In the border region, the first data line 221 and the first electrode plate 111 are arranged in a same layer.

Conventionally, when the first data line 221 enters the border region from the main display region, for the consideration of shielding signal crosstalk and the like, it is necessary to switch the line to an underlying metal for wiring design. Specifically, the display panel includes at least three layers of metal, which may be named, upwards from the substrate, as M1 metal layer, MC metal layer and M2 metal layer. In the main display region, the first data line 221 is formed by patterning the M2 metal layer. When entering the border region, the first data line 221 is switched from the M2 metal layer to the M1 metal layer. The line switching may be realized by means of a conventional via process.

In the embodiment provided in the present disclosure, the first data line 221 and the first electrode plate 111 are provided in a same layer, enabling the first data line 221 to be electrically connected to the first electrode plate 111 directly through the same layer of metal, without additional via process, which may simplify the manufacturing process for the load compensation unit 110. In addition, because of the electrical connection between the first electrode plate 111 and the first data line 221, a data signal on the first data line 221 will be transmitted through the first electrode plate 111. In this case, the second electrode plate 112 arranged above the first electrode plate 111 may serve to shield other signals, and therefore avoid interference of other signals on the data signal.

In an implementation, the second electrode plate 112 may further be connected to a preset fixed potential, so that the second electrode plate 112 may be more capable of shielding signal. In this way, the data signal in the first electrode plate 111 and on the first data line 221 connected to the first electrode plate 111 may be protected from interference due to other possible signals (such as touch signals) on an upper layer of the first electrode plate 111.

As discussed above, in the border region, both of the first data line 221 and the first electrode plate 111 may be formed by the M1 metal layer, and the second electrode plate 112 is arranged on the side of the first electrode plate 111 facing away from the substrate. Therefore, the second electrode plate 112 may be formed using an MC metal layer or an M2 metal layer.

Figure 8:
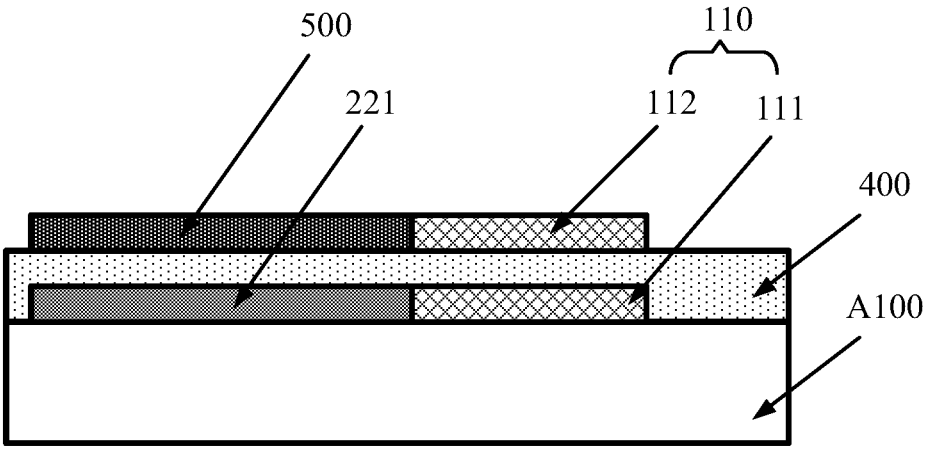
FIG. 8 is another schematic sectional view of a display panel according to an embodiment of the present disclosure.

FIG. 8 is a schematic sectional structure diagram of a display panel according to another embodiment of the present disclosure. As shown in FIG. 8, the display panel further includes a power line 500. The power line 500 and the second electrode plate 112 are arranged on a same layer, and the second electrode plate 112 is electrically connected to the power cord 500. In this case, the second electrode plate 112 may be formed with the MC metal layer, and thus being on a same layer as the power line 500 formed with the MC metal layer. The power line 500 may be electrically connected to the second electrode plate 112 directly through the same metal layer without performing a via process, which may help to simplify the process for manufacturing the display panel. For an Organic Light-Emitting Diode (OLED) display panel, a power line 500 includes a first power line PVDD and a second power line PVEE. The first power line PVDD provides a high potential, and the second power line PVEE provides a low potential. In this case, the power line 500 discussed as being electrically connected to the second electrode plate 112 is specifically the first power line PVDD. For a liquid crystal display (LCD) display panel, a power line 500 includes a third power line VGH and a fourth power line VGL. The third power line VGH provides a high potential, and the fourth power line VGL provides a low potential. In this case, the power line discussed as being electrically connected to the second electrode plate 112 may specifically be the third power line VGH.

Furthermore, the power line 500 electrically connected to the second electrode plate 112 may directly provide the preset fixed potential for the second electrode plate 112 without additional structures for electrical connection and potential providing, which may help to simplify the structural complexity of the display panel.

The following description illustrates a specific arrangement of a load compensation unit.

Figure 9:
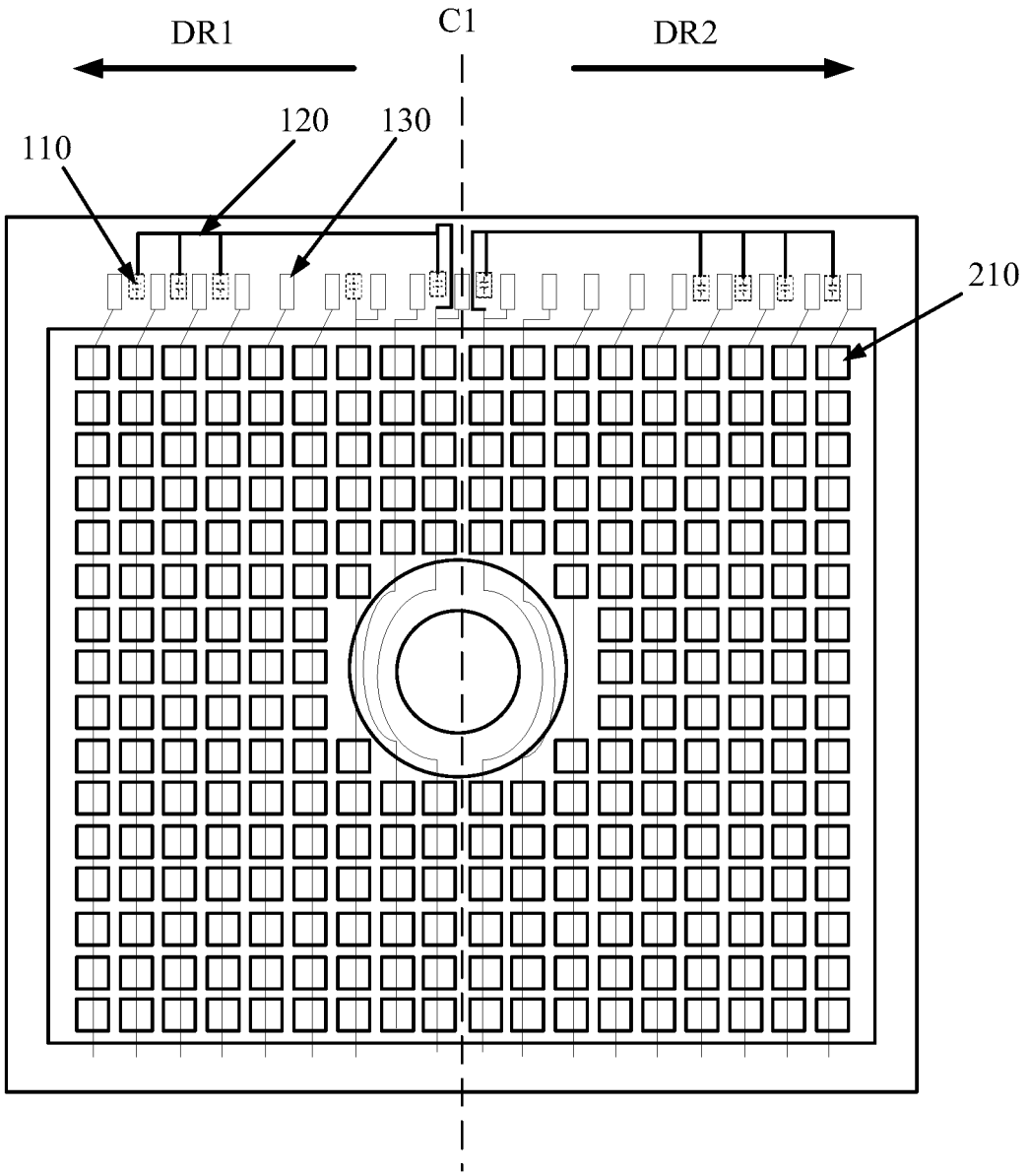
FIG. 9 is another schematic top view of a display panel according to an embodiment of the present disclosure.

FIG. 9 is a schematic top view of a display panel. As shown in FIG. 9, among the M load compensation units 110 connected to the first data line, one load compensation unit 110 is arranged in the border region in a direction where the first data line extends in the main display region. The remaining load compensation units 110 are arranged in the border region in an extending direction of at least part of the second data line.

Thus, according to the present embodiment, among the M load compensation units 110 electrically connected to the first data line that is to be compensated, one load compensation unit 110 is arranged in the border region directly above the first data line. The remaining M−1 load compensation units 110 are arranged in the border region directly above the second data line that does not require load compensation. In this way, space in the border region may be fully used and it is not necessary to additionally expend the border region for the load compensation units 110.

More specifically, as shown in FIG. 9, among the M load compensation units 110 connected to the first data line, the load compensation units 110 arranged in the border region in an extending direction of the second data line and the first data line connected to the load compensation units 110 are arranged on the same side of a first dividing line C1 of the optical component region.

The first dividing line C1 has an extending direction that is the same as the direction where the first data line extends in the main display region, and besides, the first dividing line C1 passes through the center of the optical component region.

More specifically, as shown in FIG. 9, the M load compensation units 110 connected to the first data line that is on the left side of the first dividing line C1 (the side indicated by the arrow DR1) are all arranged on the left side of the first dividing line C1, and the M load compensation units 110 connected to the first data line that is on the right side of C1 (the side indicated by the arrow DR2) are all arranged on the right side of the first dividing line C1. On one hand, such arrangement makes load compensation units 110 electrically connected to a data line that is on either side of the first dividing line C1 are evenly distributed in the border region on this side, which may help to make a full use of the border region on the side. On the other hand, the M load compensation units 110 connected to a data line being all distributed on a same side may help to reduce the length of the connection line among the load compensation units 110.

Further according to the embodiment of the present disclosure as shown in FIG. 9, for all first data lines and the M load compensation units 110 electrically connected to the first data lines, the M−1 loads compensation unit 110 disposed in the border region in an extending direction of the second data line are arranged in ascending order according to values of M from the border region in the extension direction of the second data line close to the optical component region to the border region in the extension direction of the second data line away from the optical component region.

More specifically, according to the embodiment provided in the present disclosure, for all first data lines and the M load compensation units 110 electrically connected to each of the first data line, as the load to be compensated for the first data line grows from small to large, the M−1 load compensation units 110 to be each arranged in the border region in an extending direction of the second data line are arranged away from the optical component region. Such arrangement may be beneficial to simplifying the layout design for the first connection line 120 connecting M load compensation units 110, and may be beneficial to realizing a layout design in which the first connection lines 120 do not overlap each other in view of a direction perpendicular to the substrate surface. In an implementation, the load compensation units 110 may be provided with loads in the same dimension. According to the embodiment provided in the present disclosure, loads in the same dimension enable the load compensation units 110 to be formed through the same process, which is beneficial to simplifying the manufacturing process for the display panel. The load compensation units 110 may be provided with loads in different dimensions, so that the border region space of a special-shaped display panel may be fully used. For example, a load compensation unit 110 with a large load may be arranged in the border region at a position where the space is relatively large, while a load compensation unit 110 with a small load may be arranged in the border region at a position where the space is relatively small.

Figure 10:
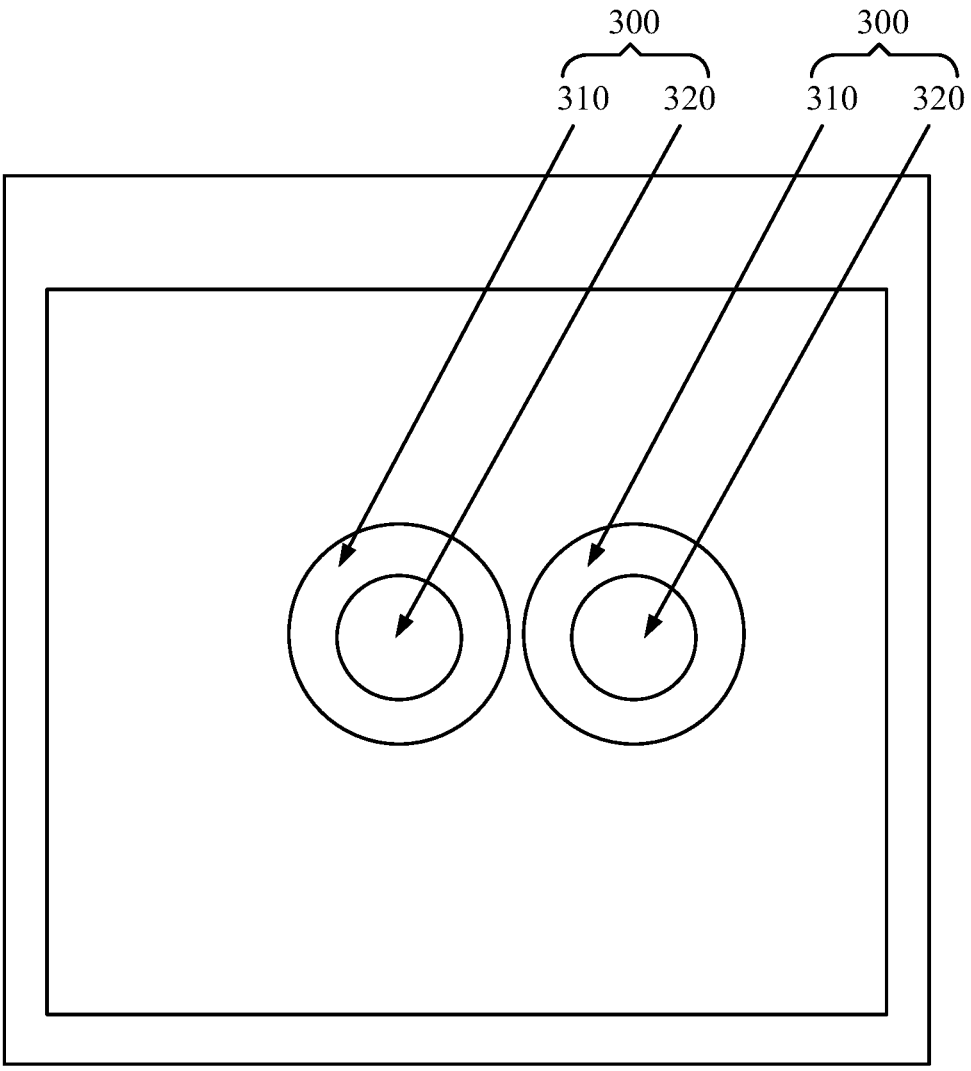
FIG. 10 is another schematic top view of a display panel according to an embodiment of the present disclosure.

Based on the above embodiment, FIG. 10 shows a schematic top view of a structure of a display panel according to another embodiment of the present disclosure. As shown in FIG. 10, a display panel has two optical component regions arranged adjacent to each other. In an implementation, there may be more than two optical component regions in the display panel.

In the embodiments of the present disclosure, the "dual-hole" display panel is taken as an example for illustrative purposes only. In the "dual-hole" display panel, each optical component region can be provided with at least one optical element.

The first data line passing through any of the optical component regions may be electrically connected to M load compensation units 110, to realize load compensation for the first data line.

Figure 11:
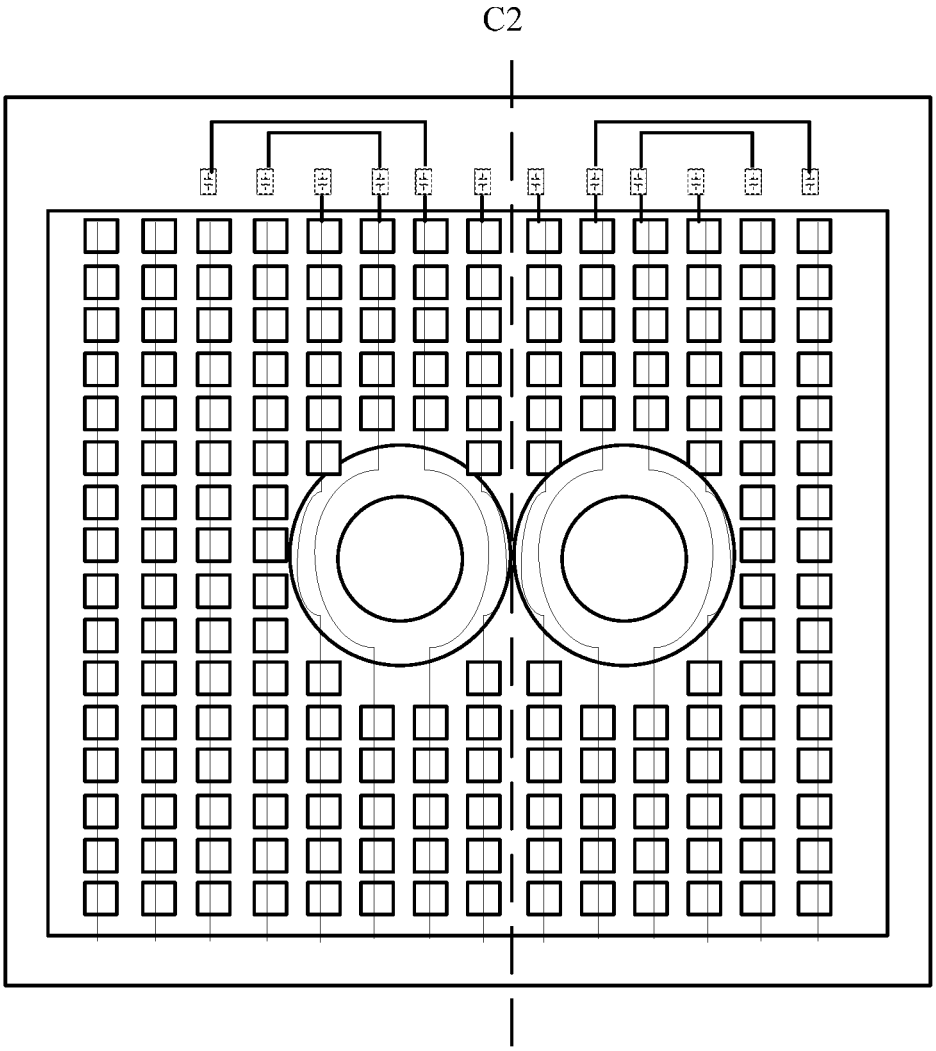
FIG. 11 is another schematic top view of a display panel according to an embodiment of the present disclosure.

FIG. 11 is a schematic top view of a structure of a display panel, which illustrates an arrangement of load compensation units 110 for a display panel with two optical component regions. As shown in FIG. 11, for the first data line which extends in the main display region in a direction intersecting with one of the optical component regions, among M load compensation units 110 connected to the first data line, one load compensation unit 110 is arranged in the border region in the direction where the first data line extends in the main display region.

The remaining M−1 load compensation units 110 are each arranged in the border region in an extending direction of the second data line and the first data line connected to the load compensation units 110 are arranged on a same side of a second dividing line C2.

The second dividing line C2 passes through a junction position of the two optical component regions and is parallel to the direction where the first data line extends in the main display region.

According to the embodiment provided in the present disclosure, the first data line and M load compensation units 110 electrically connected to the first data line are arranged on the same side of the bisector (i.e., the second dividing line C2) for the two optical component regions. On one hand, such arrangement realizes an even distribution, over a side of the second dividing line C2, of load compensation units 110 electrically connected to the first data line on the side of the second dividing line C2, which is beneficial to a full use of the border region on the side. On the other hand, it is beneficial to reducing the length of a connection line among the load compensation units 110.

Figure 12:
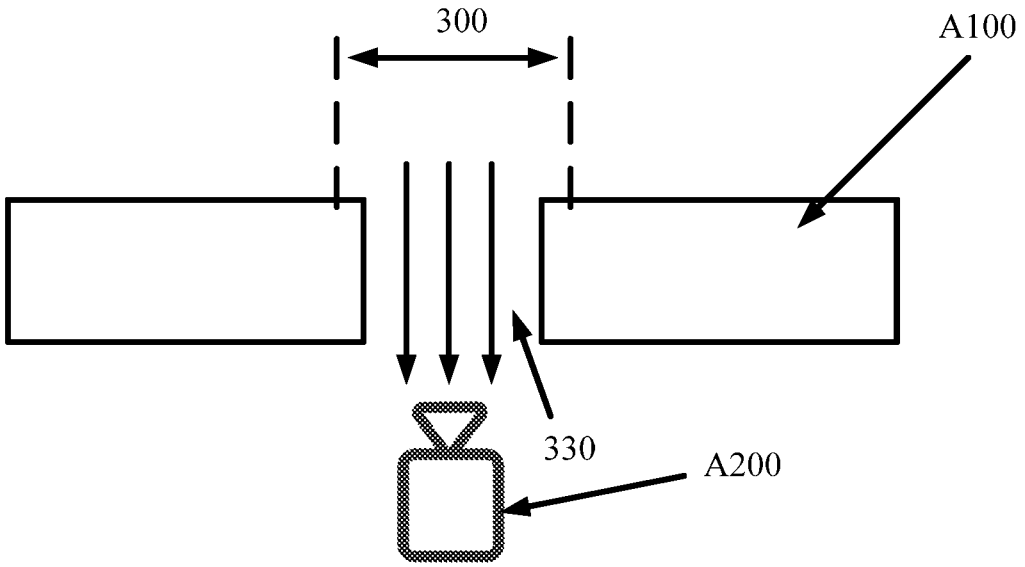
FIG. 12 is another schematic sectional view of a display panel according to an embodiment of the present disclosure.
Figure 13:
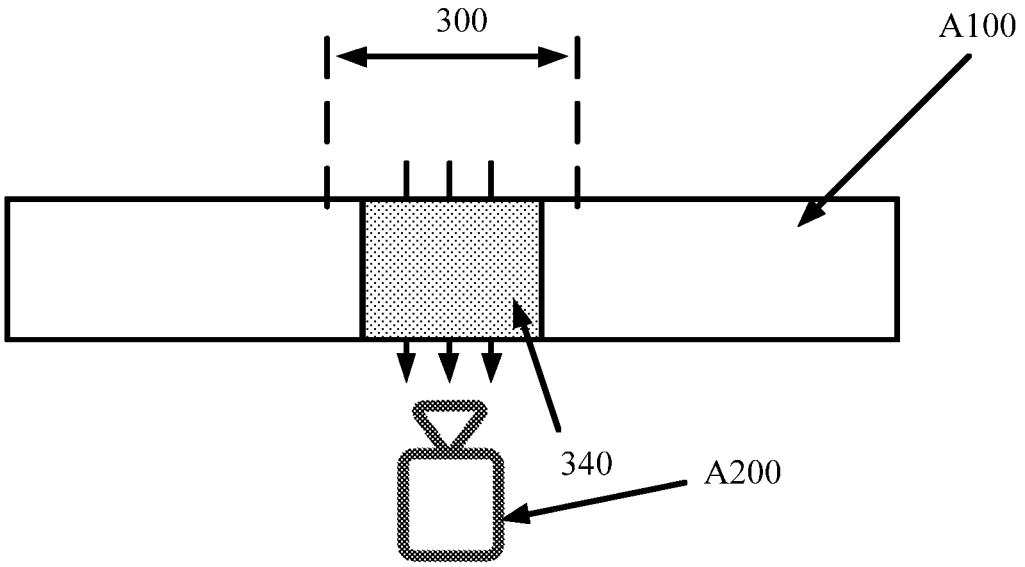
FIG. 13 is another schematic sectional view of a display panel according to an embodiment of the present disclosure.

FIGS. 12 and 13 are schematic sectional views of a display panel, which illustrate a specific arrangement of an optical component region. As shown in FIG. 12, the optical component region 300 is hollowed out (not blocked), that is, the light transmittance of the optical component region 300 is increased by means of a through hole 330, so as to meet the light transmittance requirements of the optical element A200 which needs to be set in the optical component region 300. Because the optical component region 300 is hollowed out, there is no other medium to block the light, which is conducive to maximize the light transmittance of optical component region 300.

As shown in FIG. 13, an optical component region 300 includes a transparent substrate 340, that is, the light transmittance of the optical component region 300 is improved by means of a blind hole. The structure shown in FIG. 13 has advantages of a simpler manufacturing process and a relatively high manufacturing yield.

Figure 14:
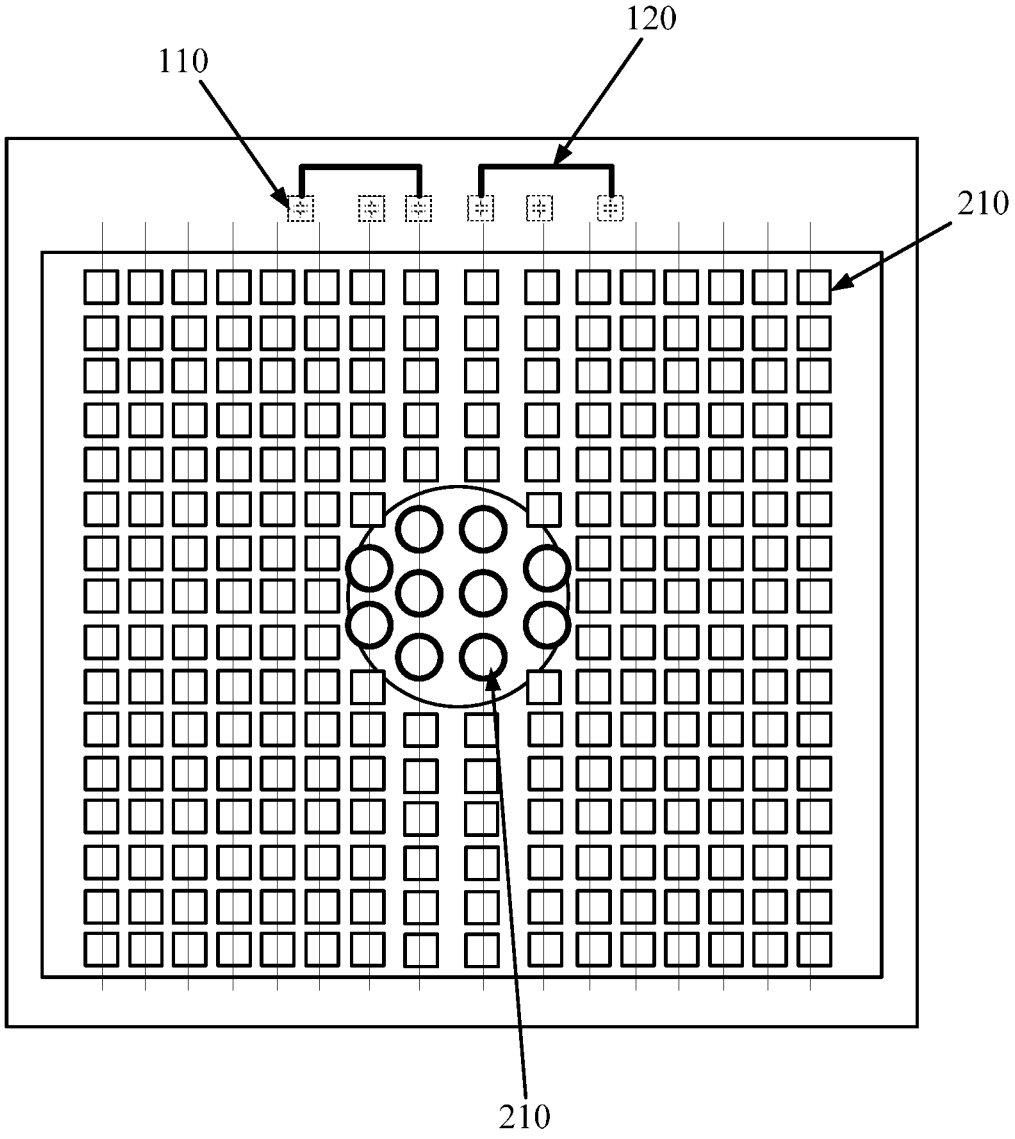
FIG. 14 is another schematic top view of a display panel according to an embodiment of the present disclosure.

As shown in FIG. 14, an optical component region 300 includes multiple display pixels 210.

In the embodiment, the optical component region 300 may also be referred to as a semi-transparent region. The provided multiple display pixels 210 enable the optical component region 300 to display (i.e., realizing a true full-screen display panel), which is beneficial to increasing a screen-to-body ratio of the display panel.

In order to meet the light transmittance requirement by the optical component A200 for the optical component region 300, the density of display pixels 210 in the optical component region 300 need to be smaller than the density of display pixels 210 in the main display region. In addition, the display pixels 210 in the optical component region 300 may be designed with a special shape or structure. For example, the cathode sharing of the display pixels 210 in the optical component region 300 may be eliminated, and anodes of the display pixels 210 in the optical component region 300 may be provided in a circular shape (as shown in FIG. 14) or any irregular shape, so as to weaken any diffraction effect of light caused by the display pixels 210.

The load compensation units 110 may be provided with loads in the same or different dimensions. In embodiments where the load compensation units 110 are provided with loads in the same dimension, it is advantageous to calculate the number of load compensation units 110 connected through the first data line. For example, assuming that a single load compensation unit 110 provides a load with a measure of X and the load to be compensated for the first data line is Y, then the number of load compensation units 110 to be connected to the first data line may be calculated as Y/X.

When the load compensation units 110 are provided with loads in different dimensions, it is advantageous to realize a layout fitting an irregular-shaped display panel. For example, if a display panel is designed to include a border region having an irregular shape which tends to become small from a middle portion above the main display region to both side portions, load compensation units 110 with relatively large load may be arranged in the border region in a middle portion above the main display region, and load compensation units 110 with relatively small load may be arranged in the border region in a side portion. In this way, it is allowed to make full use of regions in the border region.

Figure 15:
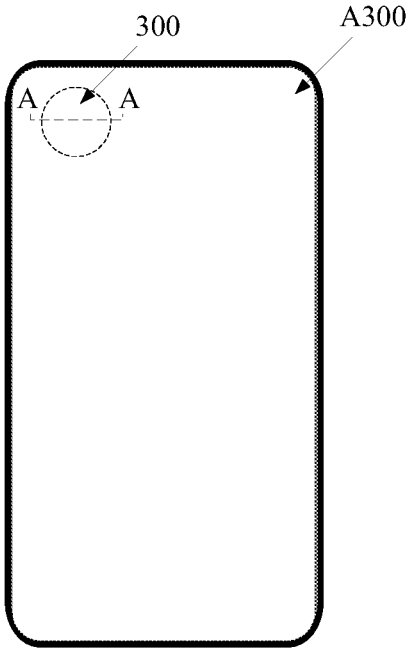
FIG. 15 is a schematic diagram of a display device according to an embodiment of the present disclosure.

Accordingly, FIG. 15 shows a schematic structural diagram of a display device A300 according to an embodiment of the present disclosure. As shown in FIG. 15, the display device A300 includes the display panel according to any of the above embodiments.

Figure 16:
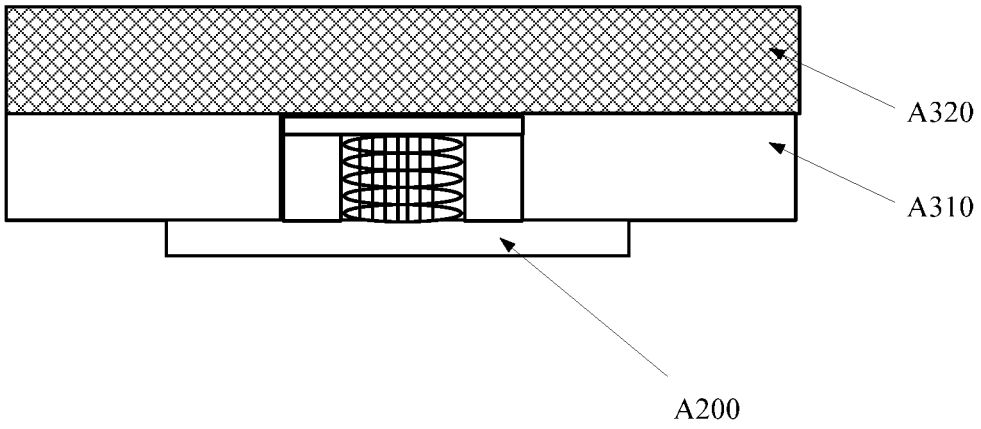
FIG. 16 is a schematic sectional view along line AA in FIG. 15 according to the embodiment of the present disclosure.

In an implementation, in a case of a display device as shown in FIG. 16, which is a schematic sectional view along line AA in FIG. 15, the display device further includes an optical element A200 arranged on the back side of the display panel corresponding to the optical component region 300.

A display panel A310 and a protective cover A320 are also shown in FIG. 16.

The optical element A200 includes, but is not limited to, any one or more of a camera, an infrared sensor, and a structured light emitter. It should be noted that the display device according to the embodiment of the present disclosure may be provided with a blind hole and be a true full-screen display device.

As described herein, embodiments of the present disclosure provide a display panel and a display device. The display panel includes a border region, an optical component region, and a main display region. The border region is provided with multiple load compensation units. At least one first data line, which extend in the main display region in directions intersect with the optical component region, is electrically connected to M load compensation units, so as to compensate for a load of the first data line, making the compensated load on the first data line and a load on the second data line are basically the same or tend to be the same. In this way, any display difference across different regions of the display panel due to the difference of the load on the first data line and the load on the second data line may be avoided, which in turn improves the display uniformity of the display panel and improves the display effect of the display panel.

Furthermore, the number of the load compensation units electrically connected to the first data line is greater than or equal to two, so that the M load compensation units electrically connected to the first data line may be distributed in the border region more flexibly. For example, the load compensation units may be distributed in a small and unused region in the border region. In other words, the load compensation units electrically connected to the first data line are allowed to be distributed in the border region as evenly as possible, so as to make full use of the space in the border region of the display panel.

Features in the embodiments of the present specification may be substituted for or combined with each other. Each of the embodiments emphasizes the differences from others, and details of the same or similar parts among the embodiments can be referred to each other.

Based on the above description of the disclosed embodiments, those skilled in the art can implement or use the technical solution in the present disclosure. Many modifications to these embodiments are apparent for those skilled in the art. General principles defined herein may be implemented in other embodiments without departing from the spirit or scope of the present disclosure. Therefore, the present disclosure is not limited to the embodiments illustrated herein, but should be defined by the widest scope consistent with the principle and novel features disclosed herein.

The invention claimed is:

1. A display panel, comprising:

a border region, an optical component region, and a main display region at least partially surrounding the optical component region;

a substrate;

a plurality of display pixels and a plurality of data lines, wherein the plurality of display pixels and the plurality of data lines are arranged on the substrate, wherein each of the plurality of data lines comprises a first data line and a second data line, wherein a number of display pixels electrically connected to the first data line is less than a number of display pixels electrically connected to the second data line, and wherein an extension direction of the first data line in the main display region intersects the optical component region; and a plurality of load compensation units arranged in the border region, wherein at least one of the plurality of the first data lines is electrically connected to M load compensation units, where M is an integer and is greater than or equal to 2.

2. The display panel according to claim 1, further comprising:

a first connection line arranged in the border region;

wherein the M load compensation units are connected in parallel through the first connection line to form a load compensation structure, and wherein the at least one of the plurality of the first data lines is electrically connected to the load compensation structure.

3. The display panel according to claim 2 wherein the first connection line is arranged on a side of the M load compensation units facing away from the main display region.

4. The display panel according to claim 3, wherein different first connection lines are non-overlapping in a direction perpendicular to a plane where the substrate is located.

5. The display panel according to claim 1, further comprising:

a first connection line arranged in the border region;

wherein the M load compensation units connected to the first data line comprises one selected load compensation unit and other M−1 load compensation units, wherein the M−1 load compensation units are connected in parallel through the first connection line, and wherein the M−1 load compensation units connected in parallel are connected in series with the selected one load compensation unit.

6. The display panel according to claim 5 wherein the first connection line is arranged on a side of the M load compensation units facing away from the main display region.

7. The display panel according to claim 1, wherein the border region further comprises a plurality of electrostatic discharge units;

wherein the plurality of electrostatic discharge units are electrically connected to the plurality of data lines, and at least one of the plurality of load compensation units is arranged between two adjacent electrostatic discharge units.

8. The display panel according to claim 1, wherein at least one of the plurality of load compensation units further comprises a first electrode plate and a second electrode plate arranged opposite to each other;

wherein the second electrode plate is arranged on a side of the first electrode plate facing away from the substrate, a first insulating layer is arranged between the first electrode plate and the second electrode plate, and the first data line and the first electrode plate are arranged in a same layer in the border region.

9. The display panel according to claim 8, wherein the first data line is electrically connected to the first electrode plate, and wherein the second electrode plate is connected to a preset fixed potential.

10. The display panel according to claim 9, further comprising:

a power line;

wherein the power line and the second electrode plate are arranged in a same layer, and wherein the second electrode plate is electrically connected to the power line.

11. The display panel according to claim 1, wherein the M load compensation units connected to the first data line comprises one selected load compensation unit and other M−1 load compensation units, wherein the selected one load compensation unit is arranged in the border region in the extension direction of the first data line in the main display region, and wherein the M−1 load compensation units are arranged in the border region in an extension direction of at least part of second data line in the main display region.

12. The display panel according to claim 11, wherein among the M load compensation units connected to the first data line, load compensation units arranged in the border region in the extending direction of the second data line and the first data line connected to the M load compensation units are arranged on a same side of a first dividing line;

wherein an extension direction of the first dividing line is the same as the extension direction of the first data line in the main display region, and wherein the first dividing line passes through a center of the optical component region.

13. The display panel according to claim 12, wherein among the M load compensation units electrically connected to the first data line, the M−1 load compensation units arranged in the border region in an extending direction of the second data line are arranged in ascending order according to values of M from the border region in the extension direction of the second data line close to the optical component region to the border region in the extension direction of the second data line away from the optical component region.

14. The display panel according to claim 12, wherein the display panel comprises two optical component regions arranged adjacent to each other.

15. The display panel according to claim 14, wherein the M load compensation units connected to the first data line of which the extension direction in the main display region intersects one of the two optical component regions comprises one selected load compensation unit and other M−1 load compensation units;

wherein the selected one load compensation unit is arranged in the border region in the extension direction of the first data line in the main display region;

wherein the M−1 load compensation units arranged in the border region in the extending direction of the second data line and the first data line connected to the M load compensation units are arranged on a same side of a second dividing line;

wherein the second dividing line passes through a junction position of the two optical component regions and is parallel to a direction of the first data line extending in the main display region.

16. The display panel according to claim 1, wherein the substrate in the optical component region is hollowed out or comprises a transparent substrate.

17. The display panel according to claim 1, wherein the optical component region comprises a plurality of display pixels.

18. The display panel according to claim 1, wherein load sizes of the plurality of load compensation units are the same or different.

19. A display device comprising a display panel;

wherein the display panel comprises:

a border region, an optical component region, and a main display region at least partially surrounding the optical component region;

a substrate;

a plurality of display pixels and a plurality of data lines, wherein the plurality of display pixels and the plurality of data lines are arranged on the substrate, wherein each of the plurality of data lines comprises a first data line and a second data line, wherein a number of display pixels electrically connected to the first data line is less than a number of display pixels electrically connected to the second data line, and wherein an extension direction of the first data line in the main display region intersects the optical component region; and a plurality of load compensation units arranged in the border region, wherein at least one of the plurality of the first data lines is electrically connected to M load compensation units, where M is an integer and is greater than or equal to 2, and the display device further comprising:

an optical element arranged on a back side of the display panel at a position corresponding to the optical component region.

* * * * *